US005419644A

United States Patent [19]

Martin et al.

[11] Patent Number: 5,419,644

[45] Date of Patent: May 30, 1995

[54] PRINT MEDIUM HANDLING SYSTEM INCLUDING COCKLE SPRINGS TO CONTROL PEN-TO-PRINT MEDIUM SPACING DURING PRINTING

[75] Inventors: Paul W. Martin, Battle Ground; Cathy A. Rotering, Camas; Sandra Y. Okazaki, Vancouver; Mark S. Hickman, Vancouver; Christopher M. Lesniak, Vancouver, all of Wash.

[73] Assignee: Hewlett-Packard Company, Palo Alto, Calif.

[21] Appl. No.: 203,113

[22] Filed: Feb. 28, 1994

Related U.S. Application Data

[63] Continuation-in-part of Ser. No. 71,417, Jun. 3, 1993.

[51] Int. Cl.[6] ..... B41J 13/10

[52] U.S. Cl. ..... 400/642; 400/578; 271/209

[58] Field of Search ..... 400/642, 646, 648, 656, 400/611, 617, 578, 624, 619, 126, 55, 56, 59; 346/140, 134; 271/188, 209

[56] References Cited

U.S. PATENT DOCUMENTS

| | | | |
|---|---|---|---|
| 3,673,960 | 7/1972 | Ricci et al. | 101/269 |
| 3,915,281 | 10/1975 | Blomquist et al. | 197/114 |
| 3,995,730 | 12/1976 | Kwan et al. | 197/127 |
| 4,095,686 | 6/1978 | Okabe | 400/150 |
| 4,537,521 | 8/1985 | Rekewitz et al. | 400/637.6 |
| 4,549,826 | 10/1985 | Stoeberl | 400/826 |
| 4,560,292 | 12/1985 | Takahashi | 400/59 |
| 4,642,661 | 2/1987 | Dean, II | 346/153.1 |
| 4,728,963 | 3/1988 | Rasmussen et al. | 346/25 |
| 4,843,338 | 6/1989 | Rasmussen et al. | 400/55 |
| 4,853,255 | 8/1989 | Onishi et al. | 427/148 |
| 5,065,169 | 11/1991 | Vincent et al. | 340/140 |
| 5,280,897 | 1/1994 | Maekawa | 271/209 |
| 5,291,224 | 3/1994 | Asano et al. | 346/134 |

*Primary Examiner*—Edgar S. Burr
*Assistant Examiner*—Anthony H. Nguyen

[57] ABSTRACT

A printer mechanism to control pen-to-print medium spacing during printing is described. The preferred embodiment of the mechanism includes a printhead and an adjacent platen. The platen includes differentially yieldable structure adapted to resiliently support the print medium thereby to inhibit uncontrolled bending of the print medium during printing. The yieldable structure preferably extend along a line generally perpendicular to a direction of feed of the print medium. The platen may further include a transition region located adjacent the yieldable structure, the transition region adapted to facilitate smooth transition of the leading edge of the print medium onto the yieldable structure.

9 Claims, 4 Drawing Sheets

PRINT MEDIUM HANDLING SYSTEM INCLUDING COCKLE SPRINGS TO CONTROL PEN-TO-PRINT MEDIUM SPACING DURING PRINTING

This application is a continuation-in-part of application Ser. No. 08/071,417, filed Jun. 3, 1993, entitled PRINT MEDIUM HANDLING SYSTEM TO CONTROL PEN-TO-PRINT MEDIUM SPACING DURING PRINTING and subject to common ownership herewith.

TECHNICAL FIELD

The present invention relates generally to pen-to-print medium spacing during printing in a wet ink printer. More particularly, the invention concerns an apparatus including cockle springs which deflect downwardly upon downward bending of the print medium. The apparatus reduces uncontrolled bending of the print medium in a print zone, the print zone positioned adjacent the wet ink printer pen.

BACKGROUND ART

Typically ink-jet printers, or any printers using wet ink, include a pen, also called a printhead, a print zone positioned adjacent the printhead, a feed mechanism for feeding print medium through the print zone, and a platen positioned adjacent the print zone, the platen guiding and supporting the print medium in the print zone during printing.

During printing, ink is placed on the print medium by dropping or ejecting the ink from the printhead, or by any other printing method well known by those skilled in the art. Ink used in wet ink type printing includes a relatively large amount of water. As the wet ink contacts the print medium, the water in the ink saturates the fibers of the print medium, causing the fibers to expand, which in turn causes the print medium to buckle. Buckling, also called cockling, of the print medium tends to cause the print medium either to uncontrollably bend downwardly away from the printhead, or to uncontrollably bend upwardly toward the printhead. In either case, a constant pen-to-print medium spacing is not achieved, leading to poor print quality. Additionally, upwardly buckling print medium may contact a pen nozzle in the printhead, leading to ink smearing on the print medium.

Typically, to achieve good print quality, pen-to-print medium spacing of less than 1.5 millimeters (mm), and preferably less than 1.0 mm, is required. However, bending amplitudes of print medium in certain pen/ink combinations can be greater than 3 mm. To reduce this problem of paper buckling, which varies the pen-to-print medium spacing, various shaped platens were designed.

The Hewlett-Packard Deskjet (a trademark of Hewlett-Packard) printer includes a platen with a flat print medium contacting surface and a feed mechanism, usually a drive roller, positioned adjacent the platen. The flat expanse of the platen is positioned below the printhead such that the platen supports the print medium throughout a print zone defined between the printhead and the platen. The feed mechanism is positioned such that print medium is fed at a downward angle onto the platen such that the print medium is concavely curved relative to the printhead in an initial region of a print zone. This small region of concave curvature generally does not extend under the pen nozzles of the printhead. Thus, during low ink density printing, the print medium does not buckle, and merely lies flat against the contacting surface of the platen throughout the print zone. However, during high ink density printing, the print medium buckles. The flat platen prevents the print material from buckling downwardly away from the printhead and so the print medium is forced to buckle upwardly toward the printhead. Thus, the Deskjet device does not adequately ensure proper pen-to-print medium spacing. In addition, the device increases the risk of ink smearing due to possible pen-to-print medium contact when the print material buckles upwardly.

The Hewlett-Packard Paintjet XL (a trademark of Hewlett-Packard) printer includes the elements of the Deskjet printer, but also includes a second drive roller positioned adjacent an exit area of the print zone. Print media are fed downwardly onto the platen from the feed mechanism, or first drive roller, extend throughout the print zone, and then travel over the second drive roller, such that the print medium are positioned between the second drive roller and an adjacent star wheel. The second drive roller is positioned generally above the platen such that the first drive roller and the second drive roller effect a generally concave curve in the print medium relative to the printhead, throughout the print zone. Because the print medium is gripped between a paper guide and the first drive roller on one side of the printhead, and between the second drive roller and a star wheel on another side of the printhead, the sheet of print medium is held in a controlled curve throughout the print zone. This controlled curve ensures proper pen-to-print medium spacing during printing, thereby ensuring good quality printing. However, inclusion of the second drive roller in the Paintjet XL printer increases the cost and complexity of the printer. Also, the possibility of ink smearing is increased because the star wheel contacts the freshly printed print medium as it presses the print medium against the second drive roller. Additionally, intake problems can arise when sheets of print media are improperly fed between the second drive roller and the star wheel.

The Hewlett-Packard Designjet (a trademark of Hewlett-Packard) printer includes a driver roller positioned beneath a printhead, the drive roller acting as a rotating platen. Sheets of print medium are fed through a print zone defined between the drive roller and the printhead. The sheets are held in contact with the curved outer surface of the drive roller on one side of the printhead by a paper guide positioned adjacent the roller on one side of the printhead, and by a star wheel positioned adjacent the drive roller on the other side of the printhead. In this arrangement, print medium are held in a generally convexly shaped curve relative to the printhead throughout the print zone. However, due to the curved surface of the drive roller, the print zone in such Designjet printers must be relatively narrow to achieve an acceptable pen-to-print medium spacing. For example, a drive roller having a radius of 31.75 mm (1.25-inches) ensures adequate print medium bending control, but would require a small print zone, and therefore a short printing array of ink nozzles in the printhead. A 12.70 mm (0.5-inch) printing array, for example, in combination with a 31.75 mm (1.25-inches) radius roller would result in a 0.063 mm (0.02-inches) change in pen-to-print medium spacing due to the drive roller curvature alone. Additionally, the possibility of ink smearing is increased due to the star wheel contacting the freshly printed medium as it forces the medium against the surface of the drive roller.

The parent application of this continuation-in part application describes a printhead, a platen, a print zone defined between the printhead and the platen, and a feed mechanism, such as a drive roller, positioned adjacent an entrance area of the print zone. The platen includes a generally flat expanse and a fixed inclined region, the inclined region including an edge which contacts the underside of the print medium along a line of contact. The feed mechanism feeds a sheet into the print zone preferably downwardly toward the platen such that the sheet contacts the platen along a line of contact. Thus, the print medium, or print material, is suspended in a generally concavely shaped curve relative to the printhead between the feed mechanism and between the line of contact, the line of contact being positioned along the flat region or in the inclined region depending on the stage of printing. Once the leading edge of the sheet is downstream of the top edge of the inclined region, the leading edge of the print material is unsupported, such that the print material can buckle downwardly, away from the printhead, avoiding the problem of ink smearing.

Typically, the inclined region edge is located generally adjacent a print zone exit region such that the print material is concavely curved relative to the printhead generally throughout the print zone, and is convexly curved relative to the printhead in the exit region of the print zone. In this arrangement, the platen supports the print material along a line of contact and effects a "reverse bow", or concavely, controlled curve in the print material throughout the print zone to ensure proper pen-to-print material spacing during printing. Due to the concave shape of the sheet relative to the edge on the inclined region, the sheet does not generally buckle upwardly at the line of contact on the edge. However, in the case of dense ink printing, the print material may tend to buckle upwardly toward the printhead and off the line of contact, which may result in ink smearing. In addition, the amplitude of this upward buckling along the line of contact, perpendicular to the sheet direction of travel, may vary. For example, the amplitude of upward buckling may be greater at a center point of the line of contact than at the sheet's edges.

DISCLOSURE OF THE INVENTION

The invented print medium handling system represents an inexpensive solution to the problem of uncontrolled print medium bending upwardly toward the printhead in a print zone, the system thereby decreasing the possibility of ink smearing. The preferred embodiment includes a printhead for printing on a print medium, and a platen located generally adjacent the printhead such that the platen and the printhead define a print zone therebetween. The platen includes differentially yieldable structure, e.g., springs separately deflectable from one another, adapted to resiliently support the print medium thereby to control bending of the print medium during printing. Specifically, a first curvature is created in the sheet between the springs and a feed mechanism, the first curvature creating controlled downward bending in the sheet. During high ink density printing, additional stress is created in this downward curvature which must be relieved to achieve proper pen-to-print medium spacing.

To relieve this additional stress, the resiliently yieldable springs are provided. Specifically, the stress in the sheet created by the first curvature and the additional stress of high ink density printing forces the sheet into a wave shaped second curvature along the line of contact between the springs and the sheet. In response, the springs separately deflect downwardly a distance which corresponds to the downward force exerted on each spring by the sheet along the second curvature. This second curvature relieves some of the additional stress created by the first curvature during high ink density printing, resulting in controlled bending of the print media during printing. Thus, the print medium, or print material, bends downwardly onto the downwardly deflected springs, such that the print medium does not bend upwardly toward the printhead. In addition, the yieldable structure, preferably cantilever springs attached to the platen at one end of the spring, move independently from one another such that the springs deflect in response to variations in bending along a line of contact between the underside of the print material and the springs.

These and additional objects and advantages of the present invention will be more readily understood after a consideration of the drawings and the detailed description of the preferred embodiment.

DETAILED DESCRIPTION OF THE PREFERRED EMBODIMENT AND BEST MODE OF CARRYING OUT THE INVENTION

Figure 1:
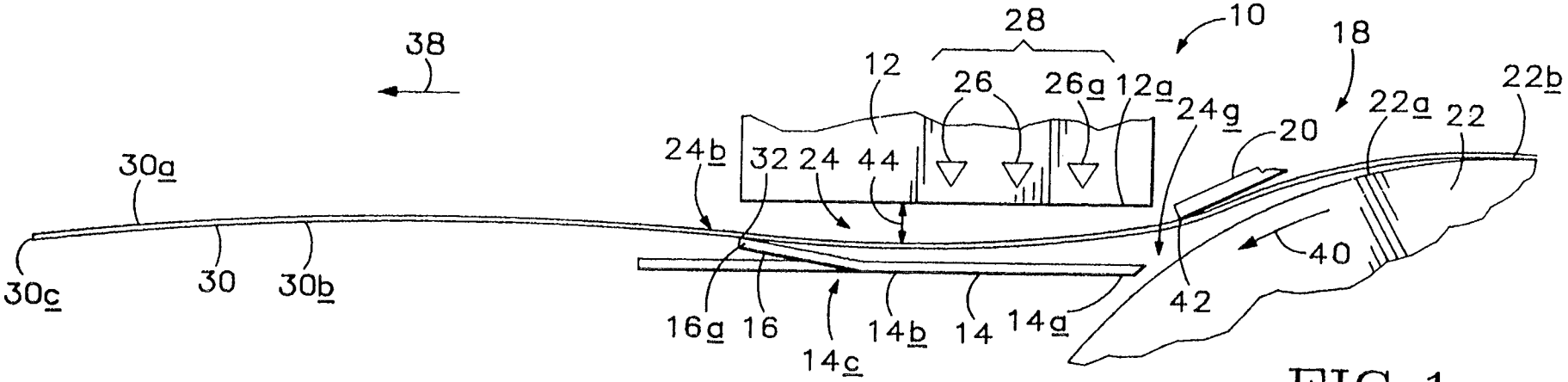
FIG. 1 shows the preferred embodiment of the print material handling system including cockle springs, with a sheet of print material supported thereon.

FIG. 1 shows the print material handling system 10 of the preferred embodiment which includes a printhead 12 and a platen 14, the platen including cockle springs 16. Print material handling system 10 may also be thought of as a printer mechanism, a print medium handling device or a print medium handling mechanism. Cockle springs 16 may also be referred to as differentially yieldable structure by which is meant, in the preferred embodiment, springs separately deflectable from one another so that the springs yield to the force of the weight of print media thereon, along an axis transverse to the direction of the media's advancement. Springs 16 may also be referred to as discrete laterally spaced spring elements. Platen 14 is positioned generally adjacent printhead 12 such that a print zone 24 is defined therebetween. In the preferred embodiment, system 10 further includes a feed device, shown generally at 18. Feed device 18 typically includes a paper guide 20 and a drive roller 22. Printhead 12 typically includes one or more nozzles 26 which together comprise a printing array 28. In operation, nozzles 26 drop or eject ink droplets onto an upper surface 30*a* of a sheet of print material 30 positioned adjacent printhead 12. Sheet 30 further includes a lower surface 30*b* which generally contacts a top surface 16*a* of cockle springs 16 along a line of contact 32 (more clearly shown in FIG. 4). Top surface 16*a* is typically a line of contact but may also be a point of contact on each spring 16 or a planar region of contact.

In another way of describing the invention, a print medium handling mechanism 10 for a printer having an ink-jet printhead 12, is adapted to permit print medium 30 bending away from printhead 12, to minimize printhead to print medium spacing 44 during printing. Mechanism 10 comprises a printhead 12 and a platen 14, the platen including multiple support springs 16 adapted for contacting the underside 30*b* of the print medium generally along a line of contact 32. The multiple support springs 16 are constructed to move separately from one another such that the springs controllably deflect upon bending of print medium 30 such that the multiple support springs 16 permit bending of the print medium away from the printhead 12.

In yet another way of describing the invention, a printer mechanism 10 is adapted to control pen-to-print medium spacing 44 during printing. Mechanism 10 comprises a printhead 12 and a platen 14, the platen located generally adjacent the printhead. The platen includes discrete, laterally spaced spring elements 16, the spring elements cooperatively configured to control bending of the print material during printing.

Still referring to FIG. 1, printhead 12 is typically horizontally positioned such that nozzles 26 are located on an underside region 12*a* of printhead 12. However, the printhead may be vertically arranged such that the nozzles are positioned on a side of the printhead wherein the sheet of print material is positioned adjacent the side of the printhead.

In operation, nozzles 26 drop or eject ink onto the upper surface 30*a* of the sheet of print material. Typically, the ink includes a relatively large amount of water such that when the ink is placed on a sheet of print material the ink saturates the fibers of the print material. This saturation causes the fibers to expand, which in turn causes buckling or cockling of the sheet material. For purposes of this invention, the sheet material may be mylar, paper, cardboard, envelope material or any such sheet material. The ink may be any liquid based wet-ink, or any other ink that causes sheet material buckling.

Figure 5:
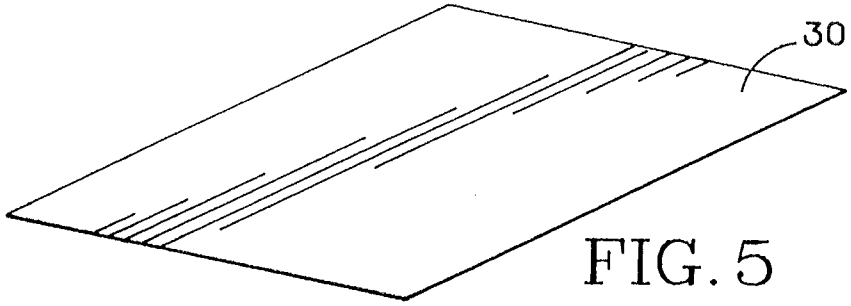
FIG. 5 shows a sheet of unprinted print material.

FIG. 5 shows an unprinted or a low ink density printed sheet of print material 30 in a flat configuration.

Figure 6:
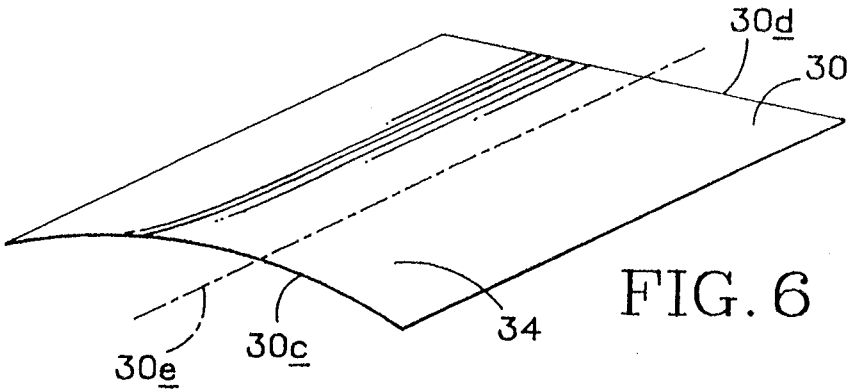
FIG. 6 shows a sheet of print material wherein the sheet has "U"-shaped bending.

FIG. 6 shows a printed-upon sheet 30 having a leading edge 30*c* which is downstream of trailing edge 30*d*. Sheet 30 is bent in a generally truncated cone shape 34 such that leading edge 30*c* has a generally inverted "U"-type shape. Truncated type bending 34 is typically symmetrical about elongate axis 30*e* of sheet 30.

Figure 7:
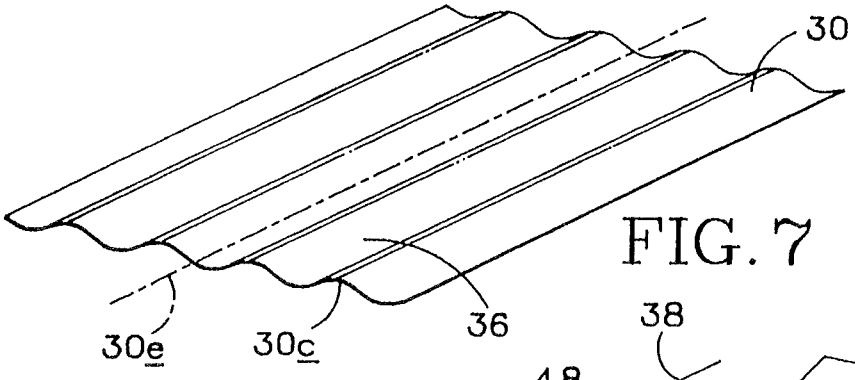
FIG. 7 shows a sheet of print material wherein the sheet has wave-shaped bending.

FIG. 7 shows a printed-upon sheet 30 bent in a wave-, or accordion-type shape 36. The wave-shaped bends 36 are generally parallel to elongate axis 30*e* such that leading edge 30*c* is generally wave, or zig-zag, shaped.

Figure 8:
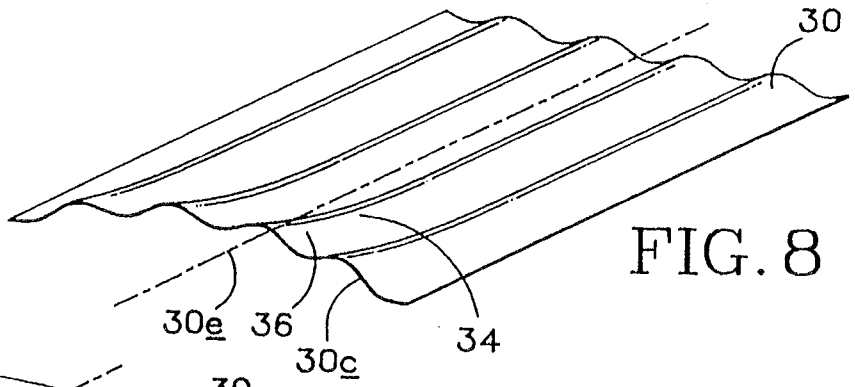
FIG. 8 shows a sheet of print material having "U"-type and wave-type bending.

FIG. 8 shows a printed-upon sheet 30 which includes truncated cone-type bending 34 and wave-type bending 36. Both types of bending are generally parallel to elongate axis 30*e* such that leading edge 30*c* has a generally inverted "U"-type shape and a generally wave-type shape.

Figure 9:
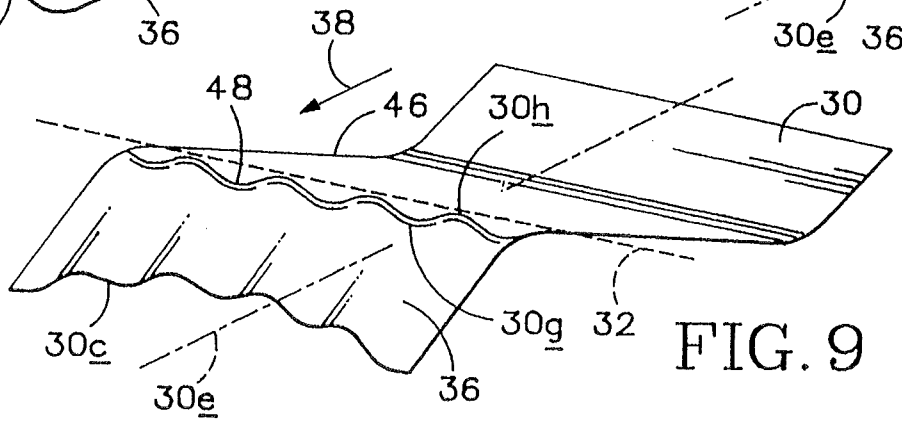
FIG. 9 shows the sheet of FIG. 8 as supported by cockle springs such that the sheet material bends downwardly, deflecting some of the springs.

FIG. 9 shows the sheet of FIG. 8 as supported on cockle springs (not shown). Sheet 30 has wave-type bending 36 along line 32 which represents the line created by top surfaces 16*a* of the least deflected springs. Specifically, the sheet bends downwardly, to form depressions 30*g*, which are supported by downwardly deflecting springs 16. The highest point 30*h* of the wave-type bends are supported by top surface 16*a* of springs 16 which are deflected less than the springs supporting depressions 30*g*, i.e., the springs positioned under depressions 30*g* are the most deflected springs. Due to the generally concave shape of sheet 30 about the springs, and due to the sheet's own resiliency, sheet 30 typically has only wave-type bending 36 along line 32 and does not have "U"-type bending along line 32. However, downstream of line 32, sheet 30 typically has both types of bending.

Referring again to FIG. 1, in the preferred embodiment, feed mechanism 18 includes print material guide 20 and drive roller 22 (only a section of the drive roller is shown for clarity). The feed mechanism 18 is typically positioned adjacent the printer input port or entrance region 24*a* of print zone 24. In operation, drive roller 22 picks a sheet from an input tray containing a stack of sheet material (not shown) and feeds or advances the sheet in direction of travel 38 into print zone 24. Specifically, a sheet of print material 30 is picked from an input tray and held against the driver roller by pinch rollers (not shown) such that under surface 30*b* of sheet 30 contacts the outer surface 22*a* of roller 22 as the roller rotates in direction 40. The upper-most point 22*b* of roller 22 is typically positioned in a plane vertically above print zone 24 such that roller 22 conveys sheet 30 generally downwardly into print zone 24 and forwardly along feed direction, or feed axis, 38.

Print material guide 20 contacts the upper surface 30*a* of the sheet and cooperates with drive roller 22 to bias the sheet downwardly into the print zone thereby ensuring that the sheet avoids contact with first nozzle 26*a*. Typically, an upstream end 14*a* of platen 14 is positioned generally adjacent drive roller 22 to prevent sheet 30 from continuing around drive roller 22 in direction 40.

Figure 4:
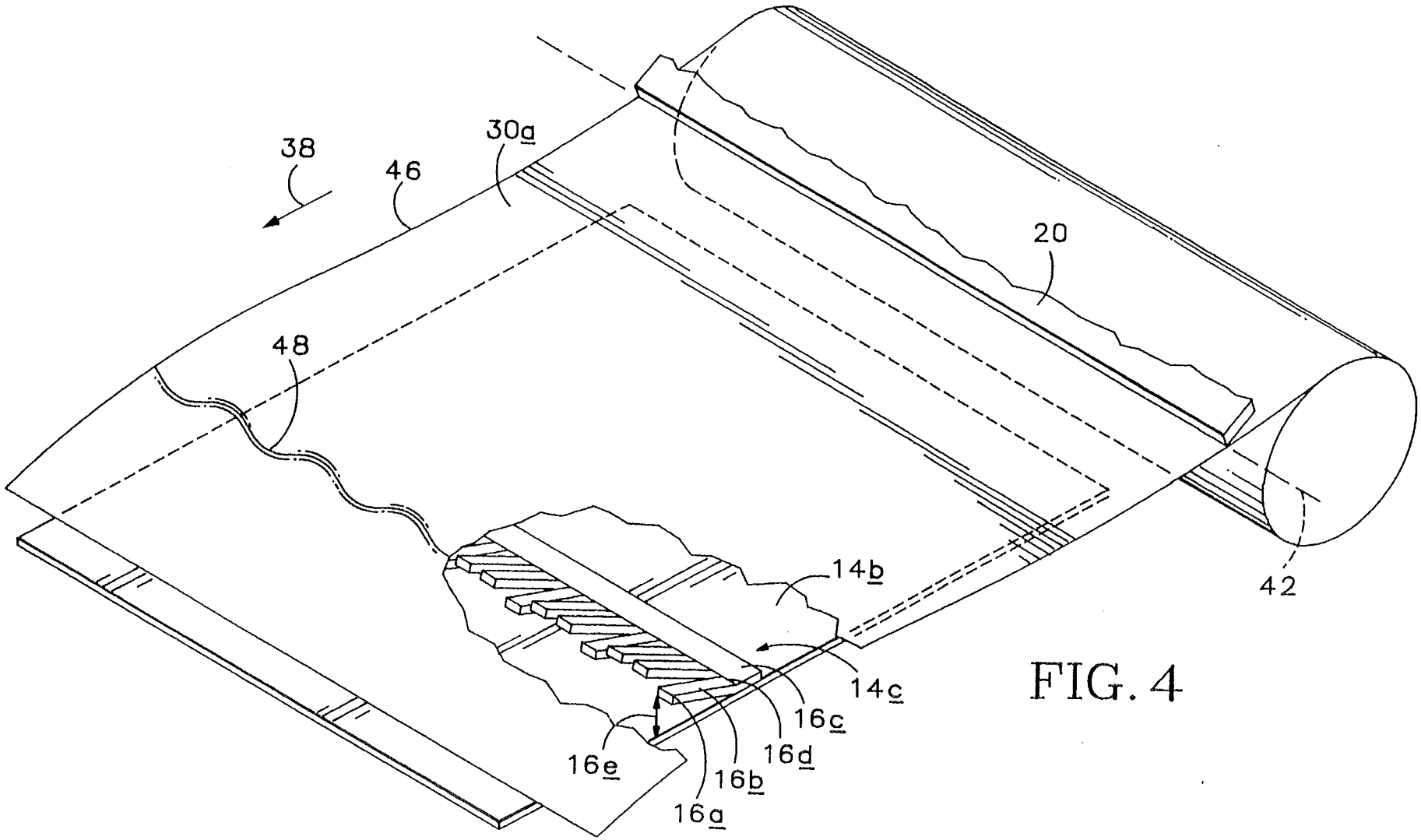
FIG. 4 shows a schematic isometric view of the preferred embodiment of the print material handling system including cockle springs, a portion of the sheet of print material cut away to reveal the cockle springs.

Still referring to FIG. 1, print material guide 20 generally contacts sheet 30 along a guide line, or region, of contact 42 (more clearly shown in FIG. 4). The guide, the roller and the platen cooperate to effect a concavely curved shape in the sheet, relative to drive roller 22, upstream of guide line of contact 42, and a generally concavely curved shape in the sheet, relative to printhead 12, downstream of guide line of contact 42. Thus, guide line of contact 42 defines a first line of inflection such that the sheet is concavely curved in one direction upstream of the line of inflection, and concavely curved in an opposite direction downstream of the line of inflection 42.

In the preferred embodiment, platen 14 includes a flat expanse 14*b* and a region of transition 14*c*, the region of transition being generally upstream of and adjacent to cockle springs 16. Transition region 14*c* may also be referred to as a transition zone. Transition region 14c, in the preferred embodiment, is a smooth transition between flat region 14b and cockle springs 16 such that as leading edge 30c of the sheet 30 is fed through print zone 24, leading edge 30c makes a smooth transition from flat region 14b of platen 14 up onto cockle springs 16. Preferably cockle springs 16 are manufactured in one integral comb-like unit having a baseplate and upwardly extending cantilever-type springs 16. The baseplate is attached to platen 14 by screws, pins or the like. Transition zone 14c may include a relatively short, smooth incline bump, so as a ramp, such that leading edge 30c moves smoothly from flat expanse 14b over the baseplate and attachment screws, and onto springs 16. In another embodiment, transition region 14c may include a recess into which the baseplate of spring 16 is inserted, thereby securing springs 16 onto flat region 14b and permitting a smooth transition of leading edge 30c on springs 16.

In use, leading edge 30c of a sheet 30 is conveyed by feed mechanism 18 into print zone 24. During this initial stage of sheet feeding, leading edge 30c is typically supported by flat region 14b. Due to the position of drive roller 22 generally above platen 14, sheet 30 is generally concavely curved relative to printhead 12 in print zone entrance region 24a. As sheet 30 is conveyed through print zone 24, leading edge 30c moves in direction of travel 38 along platen 14. Uncontrolled bending typically does not occur in this initial stage of sheet feeding because all the nozzles of printing array 28 have not yet printed on sheet 30.

Still referring to FIG. 1, as feed mechanism 18 further conveys sheet 30 in direction 38, leading edge 30c moves through transition zone 14c and smoothly contacts cockle springs 16. As leading edge 30c is further conveyed in direction 38, leading edge 30c passes over the top surface 16a of the cockle springs such that cockle springs 16 contact underside 30b along spring line of contact 32, (more clearly shown in FIG. 4) and nozzles 26 print on upper surface 30a of sheet 30. Thus, sheet 30 is suspended in a first curvature 46 between feed mechanism 18 and top surface 16a of cockle springs 16. In this manner, cockle springs 16 and feed mechanism 18 effect a generally concave shape, or curvature, 46 in the sheet relative to printhead 12 in the portion of the sheet which is upstream of spring line of contact 32. First curvature 46 creates stress in the sheet which inhibits cockling, or bending, during low ink density printing. The weight of sheet 30, and the stress in the sheet created by first curvature 46 is evenly balanced by all springs 16 acting together to support sheet 30.

As shown in FIG. 4, cockle springs 16 are typically cantilever-type leaf springs, meaning the springs are attached at one end to flat region 14b. The springs are arranged generally parallel to sheet direction of travel 38, i.e., the springs are in line generally perpendicular to direction of travel 38. Springs 16 typically include a top surface 16a, which may be a point or a flat plateau, but which is preferably a line. Springs 16 typically taper downwardly away from top surface 16a, opposite to direction of feed 38, to a lower end 16d. Lower end 16d is typically attached to a baseplate 16c, and the baseplate is in turn attached to flat region 14b. In the preferred embodiment, springs 16 are typically manufactured as one integral comb-like unit, wherein individual springs are attached at a lower end 16d to a baseplate 16c. Springs 16 are typically in the range of 1 to 3 mm wide and preferable 2 mm wide, measured along top surface 16a. Springs 16 are typically 11 mm long, measured along inclined surface 16b which extends from top surface 16a to lower end 16d. In the preferred embodiment, top surface 16a, in a undeflected state, is spaced a height 16e approximately 5 mm above flat region 14b of platen 14. Preferably, springs 16 are spaced approximately 11 mm apart, and may be in the range of approximately 5 to 20 mm apart, measured from the center of one spring to the center of an adjacent spring. Typically, the springs are manufactured of resilient, yieldable material such as thin metal. A metal such as aluminum is preferred due to its inexpensive cost and ease of manufacturing the springs, such as by stamping.

Referring to FIG. 9, as more ink is printed on sheet 30 during high ink density printing, the fibers in the sheet tend to expand, creating additional stresses within sheet 30. Due to the variable deflection characteristics of separate springs 16, the sheet tends to bend in wave-type bends, also called second curvature 48, along line of contact 32, deflecting some of the springs downwardly.

The tendency of sheet 30 to deflect some of the springs 16 downwardly is enhanced by another factor. Wave-type cockling along line 32, also called second curvature 48, tends to stiffen sheet 30 along axis 30e. This stiffening tends to decrease first curvature 46, thereby increasing the load on springs 16, and deflecting the springs downwardly even further. This additional factor further decreases the possibility of ink smearing due to upwardly bending print media because first curvature 46 is decreased.

Furthermore, this wave-type cockling along second curvature 48 tends to raise portions 30h off the springs, whereas low portions 30g tend to bend downwardly onto the springs. The greater load carried by springs 16 under lower portions 30g tends to deflect these springs more than the springs in contact with upper portions 30h. In this manner, the whole sheet is lowered which brings raised portions 30h down into contact with springs 16. In addition, as high-density ink printing occurs, sheet 30 becomes heavier with ink such that springs 16 are deflected even more. Thus, as high-density ink printing increases, load-bearing springs 16 deflect downwardly such that sheet 30 deflects away from printhead 12 thereby avoiding ink smearing and maintaining an acceptable pen-to-print material spacing 44. In a preferred embodiment, the resiliency of springs 16 is based on sheet properties, such as stiffness, such that the springs deflect downwardly to maintain a relatively constant pen-to-print medium spacing 44.

Typically, springs 16 are positioned downstream of printing array 28, and are preferably positioned in an exit region 24b of print zone 24. In this position, springs 16 contact sheet 30 away from paper guide 20, which provides a well defined amount of stress in sheet 30 to force the desired frequency and direction of bending in first curvature 46. Positioning of springs 16 closer to paper guide 20 may result in unnecessary stress in the first curvature, and therefore unnecessary bending in sheet 30. This unnecessary stress may have adverse effects, including creating unwanted bending in the sheet between springs 16 and paper guide 20, during low-ink density printing. In addition, positioning springs 16 generally adjacent pen array 28 may add unnecessary resistance to sheet feeding. However, if such adjacent spring positioning is desired then such resistance could be avoided by choosing an appropriate resiliency of springs 16 to relieve the resistance.

Figure 2:
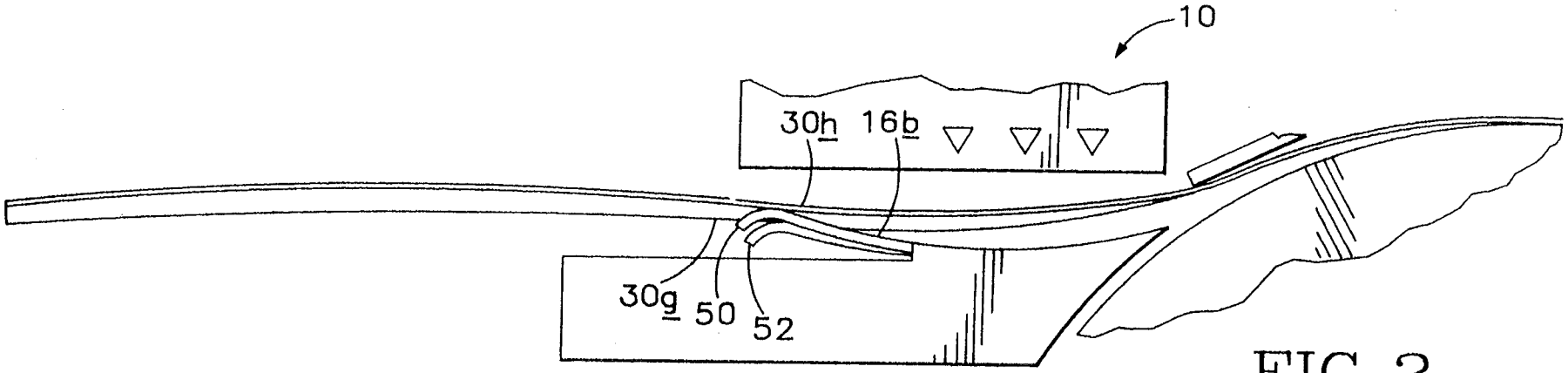
FIG. 2 shows a second embodiment of the print material handling system including cockle springs, with a sheet of print material cockling downwardly deflecting some of the springs.

As shown in FIG. 2, springs 16 may include a rounded inclined surface 16*b* which contacts underside 30*b* of sheet 30. Individual springs 16 deflect separately and differentially from one another so that some springs 50 may be deflected downwardly by high points 30*h* whereas other springs 52 may be deflected downwardly by low points 30*g* of sheet 30.

Figure 3:
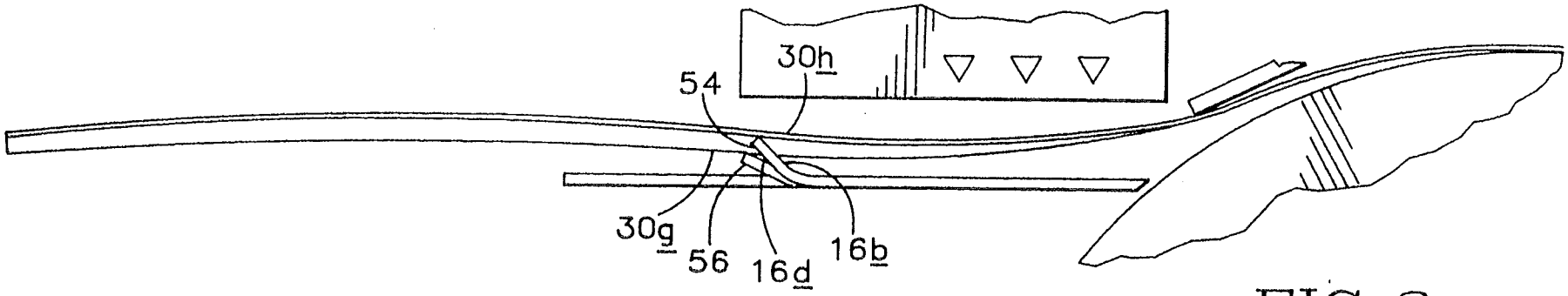
FIG. 3 shows a third embodiment of the print material handling system including cockle springs, with a sheet of print material cockling downwardly deflecting some of the springs.

As shown in FIG. 3, springs 16 may comprise upwardly extending projections having a flat inclined surface 16*b*, generally parallel with a back surface 16*d*. Springs 16 individually deflect downwardly corresponding to the downward force of sheet 30. Specifically, some springs 54 may be deflected downwardly by high points 30*h* whereas other springs 56 may be deflected downwardly by low points 30*g* of sheet 30.

In another embodiment, springs 16 may comprise discrete components individually attached to platen flat region 14*b*. In another embodiment, springs 16 may comprise a brush type element with a large number of fine spring elements. In another embodiment, springs 16 may be multiple coil springs. In another embodiment, springs 16 may include a paper contacting lever element having a spring element positioned below the lever and pushing upwardly on the lever. In this embodiment, the spring does not actually contact the sheet, but instead acts to force the lever element into contact with sheet 30 and permits the lever to deflect downwardly in response to downward forces by sheet 30.

Industrial Applicability

It may be seen that the invented apparatus 10 ensures proper printhead-to-print material spacing 44 by reducing uncontrolled bending of print material 30 in a print zone 24 through use of a platen 14 which contacts the sheet material 30 generally along a line of contact 32, and which allows the sheet to bend downwardly, deflecting cockle springs 16. The inventive platen reduces uncontrolled bending of print material in the print zone without the incorporation of an expensive and complex second drive roller and without increasing the risk of ink smearing due to printhead-print material contact. The print material handling system 10, which includes a platen 14 with cockle springs 16, uses the print material's own weight and elasticity to effect a controlled first curvature 46 in the print material between the ribs and a guide mechanism. The system also creates a controlled second curvature 48 along separately deflecting springs, to achieve a relatively constant pen-to-print medium spacing 44 so that spacing 44 can initially be set at a small distance which increases the print quality of printing on sheet 30.

While the present invention has been shown and described with reference to the foregoing preferred embodiment, it will be apparent to those skilled in the art that other changes in form and detail may be made therein without departing from the spirit and scope of the invention as defined in the appended claims.

We claim:

1. A printer mechanism adapted to control pen-to-print medium spacing during printing, the mechanism comprising:

a printhead adapted for printing on a print medium, and a platen located adjacent the printhead, the platen including a resilient print medium support structure having a plurality of contact regions which yield independently to differentially support the print medium in an undulated flexure during printing.

2. The mechanism of claim 1 wherein the print medium support structure extends along a line generally perpendicular to a direction of feed of the print medium.

3. The mechanism of claim 1 wherein the print medium support structure includes a plurality of discrete springs.

4. The mechanism of claim 3 wherein the springs are leaf springs.

5. The mechanism of claim 1 wherein the print medium support structure contacts the print medium along a line of contact which is substantially perpendicular to a feed direction of the print medium.

6. A print medium handling mechanism for a printer having an ink-jet printhead, the mechanism being adapted to permit print medium bending away from a printhead to minimize printhead to print medium spacing during printing, the mechanism comprising:

a printhead adapted for printing on a print medium, and a platen including a plurality of discrete contact regions, each supported by independent springs which move independently of one another such that the platen deflects differentially in an undulated flexure upon bending of the print medium.

7. The mechanism of claim 6 wherein the platen further includes a transition region adjacent the support springs, the transition region being adapted to facilitate smooth transition of a leading edge of the print medium onto the support springs.

8. A printer mechanism to control pen-to-print medium spacing during printing, the mechanism comprising:

a printhead adapted for printing on print medium; and a platen located generally adjacent the printhead, the platen including discrete, laterally spaced leaf spring elements cooperatively configured to control bending of the print material during printing.

9. The mechanism of claim 8 wherein the spring elements contact the print medium along a line of contact substantially perpendicular to a direction of travel of the print material.

* * * * *